US005612091A

United States Patent [19]

Paloviita et al.

[11] Patent Number: 5,612,091

[45] Date of Patent: Mar. 18, 1997

[54] METHOD AND APPARATUS FOR CONTROLLING THE COAT PROFILE IN COATERS BASED ON SHORT DWELL TIME APPLICATION

[75] Inventors: Petri Paloviita, Vantaa; Jukka Linnonmaa, Järvenpää, both of Finland

[73] Assignee: Valmet Corporation, Helsinki, Finland

[21] Appl. No.: 544,065

[22] Filed: Oct. 17, 1995

[30] Foreign Application Priority Data

Oct. 24, 1994 [FI] Finland ..... 944991

[51] Int. Cl.[6] ..... B05D 3/12

[52] U.S. Cl. ..... 427/355; 427/356; 427/359; 118/119; 118/126; 118/410; 118/413

[58] Field of Search ..... 427/356, 355, 427/359; 118/126, 410, 413, 119

[56] References Cited

U.S. PATENT DOCUMENTS

| | | | |
|---|---|---|---|
| 4,250,211 | 2/1981 | Damrau et al. | 427/356 |
| 4,387,663 | 6/1983 | Alneid | 118/413 |
| 4,452,833 | 6/1984 | Holt | 427/356 |
| 4,537,801 | 8/1985 | Takeda | 427/356 |
| 4,697,542 | 10/1987 | Kohler et al. | 118/63 |
| 4,791,879 | 12/1988 | Eklund et al. | 118/50 |
| 4,834,018 | 5/1989 | Sollinger et al. | 118/410 |
| 4,858,553 | 8/1989 | Westergard et al. | 118/126 |
| 4,920,913 | 5/1990 | Knop et al. | 118/410 |
| 4,934,310 | 6/1990 | Wöhrle et al. | 118/410 |
| 4,964,364 | 10/1990 | Kärnä et al. | 118/410 |

FOREIGN PATENT DOCUMENTS

| | | | |
|---|---|---|---|
| 893360 | 1/1991 | Finland . | |
| 3446525A1 | 8/1985 | Germany | 118/410 |
| 93/05887 | 4/1993 | WIPO | 118/126 |

*Primary Examiner*—Katherine A. Bareford
*Attorney, Agent, or Firm*—Cohen, Pontani, Lieberman, Pavane

[57] ABSTRACT

A method and apparatus for controlling the coat profile in short dwell time coaters and similar apparatuses in which the coating mix is applied to the web, over a brief time interval, in an application chamber disposed immediately upstream of a doctoring element. Excess coating mix flows counter to the running direction of the web over the front edge of the application chamber. The distance between the web and the front edge of the coating chamber is adjustable, allowing the cross-machine profile of the coating to be controlled.

14 Claims, 1 Drawing Sheet

METHOD AND APPARATUS FOR CONTROLLING THE COAT PROFILE IN COATERS BASED ON SHORT DWELL TIME APPLICATION

FIELD OF THE INVENTION

The present invention relates to a method and apparatus controlling the coat profile in short dwell time coaters and similar equipment used in coating a paper or paperboard web.

BACKGROUND OF THE INVENTION

Paper web coating is today implemented using a variety of different methods. Short dwell time coaters are employed particularly as on-machine coaters due to their good running properties. Good running characteristics are based on a low application pressure and a short distance between application and doctoring. In short dwell time application, the coating mix cannot penetrate deeply into base web, the required doctoring force remains low and, due to the short time interval between application and doctoring, wetting of the base web and resulting loss of base web strength is less than in other coaters.

In the art, the "short dwell time coater" is generally denoted by the abbreviation SDTA (Short Dwell Time Applicator). In this type of coater, the coating mix is passed into an application chamber located immediately to the rear of the doctor blade, whereby one wall of the chamber is formed by the moving web supported by a backing roll, one wall by the doctor blade and one wall on the incoming side of the web by the front wall of the chamber. The coating mix is fed into the application chamber via a feed slit disposed at the bottom of the chamber, and a major portion of the infed mix is routed past the front wall edge back for coating mix recirculation. The purpose of the outflow of the coating mix past the front edge, counter to the web travel direction, is to reduce the access of the air layer travelling along with the running web into the application zone, to assure even distribution and replenishment of the coating mix flow and to keep the mix outflow slit open. Such a coating apparatus is described, for example, in U.S. Pat. No. 4,350,211.

To achieve an even surface profile of the web, some kind of coat profile control may be required. Such need for control is typically dictated by the unevenness of the base paper web profile or various factors related to equipment employed and by prevailing process conditions. Conventionally, the profile control is implemented by altering the doctor blade settings and a number of different control methods and equipment are known in the art.

U.S. Pat. No. 4,405,661 describes a coater of the above-mentioned type having the distribution of the coating mix in the application chamber as well as the evenness of application improved by a specific arrangement of the mix feed slit. In this apparatus the doctor blade is loaded by a pressurized loading hose, and the linear loading of the blade is controlled by adjusting the hose pressure and adjustment screws attached to the hose. The cross-machine profile of the doctor blade can be adjusted within certain limits by altering the control screw settings. The distance of the front edge on the incoming side of the web and the web is adjusted by a servo-controlled screw. However, this apparatus offers rather limited control capabilities of the coat profile because the pressurized hose absorbs a portion of the profile adjustment exerted by means of the control screws. U.S. Pat. No. 5,109,792 discloses an apparatus in which an improvement in coat quality is attempted by way of tighter sealing of the application chamber. This goal is achieved by means of an elastic seal element attached to the front edge of the chamber. The purpose of the seal element is to prevent the backflow of the coating mix and thus increase the internal pressure of the application chamber. This apparatus offers reduced backflow combined with lower risk of damage to the backing roll in the case of a web break. The doctor blade loading and profile control are implemented in the same way as in U.S. Pat. No. 4,405,661.

Finish Patent No. 91,025 describes a method for measuring the coat profile and adjusting the doctor blade profile in a coater. According to this method, the cross-machine profile of the amount of the coating mix applied on to the web in the coating station is measured continuously, and, on the basis of the measurement result, the blade profile is adjusted by means of elements controlling either the blade directly or via the blade support beam. This method is not limited to any particular doctor blade construction, but rather, is suited for controlling a variety of equipment having a doctor blade profile adjustment facility.

Coat profile control based on doctor blade profile control and doctor blade loading adjustment has several shortcomings. For instance, as the doctor blade loading changes with the adjustment of the blade profile, uneven doctor blade wear results. Such uneven wear causes a need for more frequent blade replacement particularly when blade profile control must be used correcting a coat profile error caused by a persistent defect of the base paper web. In such a case, the coater must be run with the same control settings for long period of time, whereby blade wear will eventually reflect in the controlled blade profile. A similar situation occurs if the profile control must be used to compensate for constructional errors of the applicator apparatus such as deflections of the blade support beam. Due to the resulting blade wear, the controlled profile will not remain stable over a longer period of time, but rather, relatively rapidly tends to assume the condition prevailing prior to the profile control operation thus necessitating frequent readjustment of the blade profile. Hence, methods based on blade profile control are not particularly desirable due to the short-term effect of the applied control measures.

Profile errors traceable to the base paper defects may also be corrected by calendering the web prior to coating. Naturally, while calendering improves paper quality, it also requires higher investments in equipment.

SUMMARY OF THE INVENTION

It is an object of the present invention to provide a method and an apparatus offering coat profile control with improved efficiency and long-term stability over the prior art in short dwell time coaters.

The goal of the present invention is accomplished by controlling the cross-machine profile of the applied coat by altering the distance between the web and the front edge of the application chamber.

The present invention offers significant benefits.

The distance between the application chamber front edge and the web has been found to exert a strong effect on applied coat weight when other application parameters are maintained constant. The gap width of the backflow slit controls the internal pressure of the application chamber and thus the amount of coating mix applied onto the web from under the doctor blade. Such a control method exerts a long-term effect and does not contribute to blade wear, whereby the blade replacement intervals will not be affected. By virtue of its long-term effect, the control method according to the present invention is significantly more advantageous than a control scheme based on blade profile adjustment. The profile control of the application chamber front edge may be combined with the blade profile control, whereby extremely wide-range and flexible control possibilities are obtained. Further, the control of the distance between the application chamber front edge and the web makes it possible to perform permanent correction of profile errors caused by straightness deviations of the coater blade support beam, blade holders or application chamber front edge and to compensate for persistent profile errors of the base paper web.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
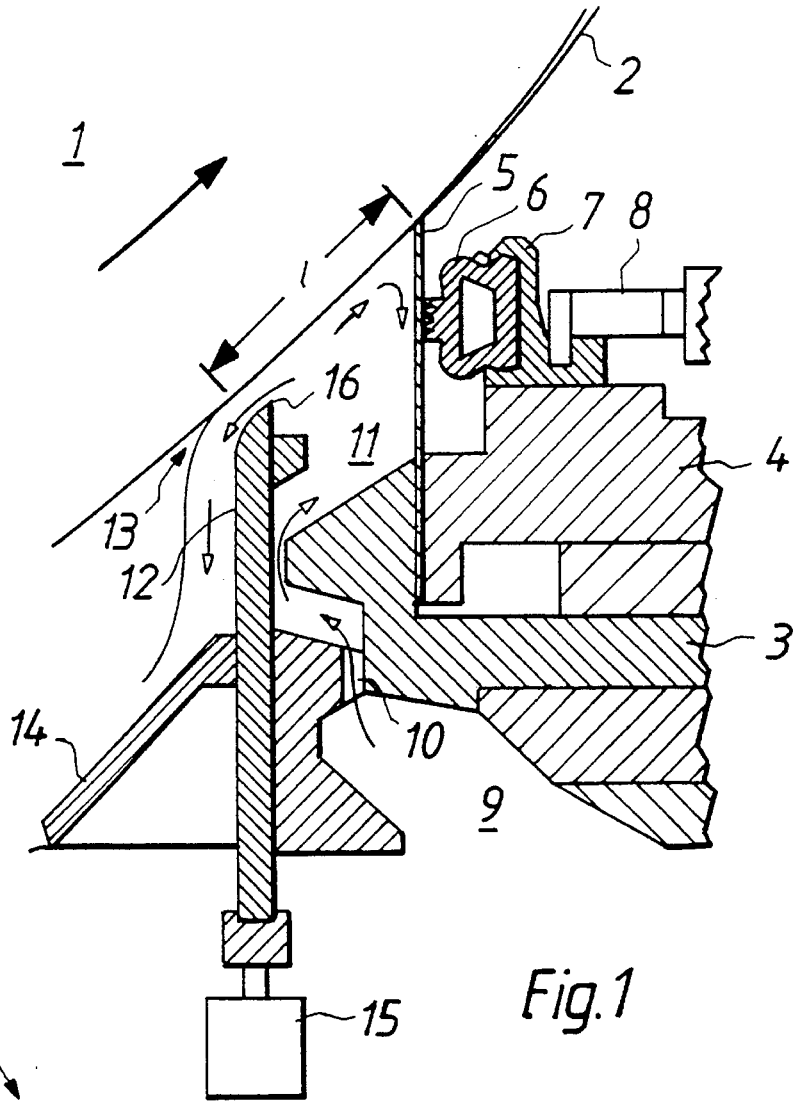
FIG. 1 is a schematic cross-sectional view of a short dwell time coater according to the present invention.

Referring to FIG. 1, the SDTA or short dwell time applicator illustrated therein is representative to the construction of short dwell time coaters employed today. This kind of prior-art apparatus is shown complemented with a controllable front edge 12 of the application chamber 11 according to the present invention. Attached to its body 3, the coater has a blade holder 4 clamping the lower edge of the doctor blade 5 to the body 3. To the blade holder 4 is connected a loading means 6, 7, 8 of the blade 5. The loading means comprises, connected to the blade holder 4, a movable support carriage 7 to which a hose 6 filled with a pressurized medium is attached. The hose 6 rests against the doctor blade 5 so as to fill the gap between the upper edge of the blade 5 and attachment of the hose 6, whereby the hose 6 loads the blade 5 against a web 2 running over a backing roll 1. The machine direction of the web 2 and the rotational direction of the backing roll 1 are indicated by the large curved arrow in FIG. 1.

The support carriage 7 of the loading hose 6 is advantageously divided into segments in the longitudinal direction of the blade 5. Each segment is provided with a control means 8 suitable to adjust the segments of the support carriage 7. Most typically, the control means 8 is a manually adjustable screw or electrically driven screw jack, while a variety of other types of control means are possible. Using such a control means 6, 7, 8, the loading of the blade 5 is conventionally carried out by first setting a suitable base value of loading by adjusting the control means 8 so as to inflate the hose 6 resting against the doctor blade 5. Run-time blade loading control is effected by dynamically adjusting the inflation pressure of the hose 6. With the help of the segmental support carriage 7 and the control means 8, the profile of the doctor blade 5 and its linear loading can also be controlled in the longitudinal direction of the blade 5. By adjusting the blade profile, the amount of applied coating mix in the cross-machine direction of the web 2 to be coated can be varied, thus permitting, for example, the correction of base paper profile defects.

The coating mix is applied to the web 2 via the application chamber 11. The walls of the application chamber 11 are formed between the doctor blade 5, the body 3 and the front edge 12 attached to an auxiliary body 14, while the chamber 11 is sealed by the web to be coated running over the backing roll 1. The coating mix is delivered into the application chamber via a feed channel 9 and a flow-evening and flow-distributing manifold of flow-constricting channels 10. The coating mix is fed to the chamber 11 in excess amount relative to the amount applied to the web 2 from under the doctor blade 5, and the excess flows upstream, i.e., counter to the running direction of the web 2 over the front edge 12 back to the collection pond, wherefrom it is circulated back to the application chamber 11. The flow of coating mix circulation are indicated by arrows in FIG. 1. The purpose of overflow past the front edge 12 is to prevent access of the air layer travelling along with the fast-running web 2 into the application chamber 11 and to assure the adherence of the coating mix to the web 2. In applicator apparatuses of the above-described kind, the application distance is short, as is evident from FIG. 1. The coating mix contacts the web 2 only for the length of the distance 1, and as the speed of the web 2 is high, the duration of contact between the web 2 and the coating mix is extremely short. Due to the short contact time and high web speed, the characteristics of the resulting coating will be strongly dependent on the application pressure and the flow pattern of the coating mix in the application chamber 11, making good control of these parameters extremely important.

The internal pressure in the application chamber 11 is determined by, among other things, the volumetric inflow rate of the coating mix and the width of the gap 13 between the front edge 12 and the web 2. When the inflow rate is increased, the pressure increases naturally concomitantly, and correspondingly, if the front edge 12 is moved away from the web 2, the chamber pressure decreases. Usually, the distance between the front edge 12 and the web 2 is made adjustable, and this adjustment effects the amount of coating mix applied to the web and the loading of the doctor blade 5.

Figure 2:
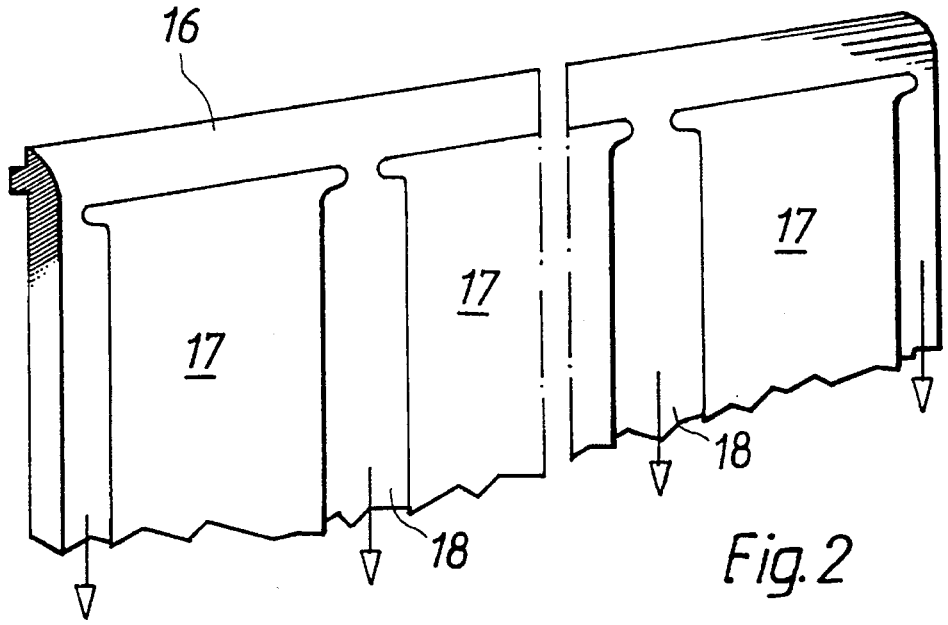
FIG. 2 illustrates the controllable application chamber front edge of a short dwell time coater according to the present invention.

The present invention is based on the findings that the coating mix profile control can be implemented by adjusting the distance between the web2 and the application chamber front edge 12 in the cross-machine direction of the web 2. In the following, this control method is called the profile control of the front edge 12. Referring now to FIG. 2, an embodiment of the front edge 12 is shown which is suitable for profile control. This front edge 12 comprises a stainless sheet steel plate having one of its long sides shaped into a curved overflow edge 16. The front edge 12 is continuous and smooth at the overflow edge 16. The front edge 12 is made sufficiently flexible in the vertical direction by means of material-reducing cuts 17. These cuts may be machined by, for example, a laser and their volume is filled with polyurethane. Downward from the continuous overflow edge 16 extend comb-like isthmuses 18, which separate the urethane-filled cuts 17 from each other. In this fashions the front edge 12 can be made flexible in the vertical direction and yet sufficiently stiff in the cross-machine direction. The profile control of the front edge 12 is accomplished by means of control screw jacks 15 connected to the isthmuses 18, shown in FIG. 1. The profile of the overflow edge 16 can thus be adjusted by pushing/pulling the isthmuses 18 with the screw jacks 15. As even the slightest change in the gap 13 between the front edge 12 and the web 2 affect the coat weight profile, the required control range need only be a few millimeters, and thus the above-described front edge construction is sufficiently flexible to provide a functional method of coat profile control.

The front edge profile control affects the internal pressure of the application chamber 11, and thus the coat weight profile. When the overflow edge 16 is moved closer to the web 2, the local pressure in the chamber 11 increases and more coat is applied to the web 2 because the local increase of the coating mix pressure moves the blade 5 farther away from the web 2, thus permitting a greater amount of coating mix to pass onto the web. Correspondingly, when the overflow edge 16 is moved farther away from the web 2, the local pressure in the chamber 11 decreases and the doctor blade 5 moves closer to the web 2 thus permitting less coating mix to pass onto the web 2. As the delivery of coating mix into the application chamber 11 is arranged as homogeneous as possible, the profile control of the front edge 12 affects locally the pressure in the application chamber 11, thus achieving the desired coat profile control.

The control method according to the present invention is suitable for use in all coaters which have the application arranged to occur in an application chamber adapted in the immediate vicinity of the doctoring element just prior to doctoring or smoothing and in which the application pressure can be adjusted by constricting the outflow of the coating mix from the application zone. In practice this definition refers to coating apparatuses having the application chamber bordered by a front edge whose distance from the web can be adjusted to control the overflow in the incoming direction of the web. No other constructional details of coater apparatus are specially required for implementing the present invention, and in fact, the invention may be employed in, for example, apparatuses in which the coat is applied to the web using a coater similar to a short dwell time applicator and is subsequently smoothed to the final coat weight by means of a separate doctor blade. Alternatively, a blade as the doctoring means can be replaced by any other element such as a bar, for instance. The final coat profile may be controlled by adjusting both the front edge and the doctor blade profile, or alternatively, the front edge profile alone. Hence, the invention can be readily adapted for coat profile control in coater apparatuses having no profile control of the doctor blade.

The construction of the adjustable front edge may be varied from the exemplifying embodiment described above. For instance, the overflow edge may be formed by a bar or rod to which perpendicular rods are attached that can be adjusted so as to control the front edge profile. In principle the overflow edge may even be provided by movable elements forming segments, while such a construction carries the risk of coat striping and stepped profile control. As any pressure steps, however, are smoothed out in the application chamber, and moreover, the doctor blade itself levels away steps in the coat profile, also the stepped control of coat profile may in the end give a good final coat quality.

The present invention can also be used in coating paperboard and other similar materials. Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. A method for controlling a coat profile of a web to be coated with a coating mix comprising:

feeding the coating mix into an application chamber formed by a surface of the web to be coated, by a doctoring means for smoothing the coating mix applied to the web, and by a front planar member, the front planar member being disposed a distance from the doctoring means in a direction counter to movement of the web, an edge of the front planar member and of the doctoring means being disposed at a distance from the surface of the web to be coated and extending across at least a portion of a width of the web;

adjusting the distance between the edge of the front planar member and the surface of the web to be coated at a plurality of points across the width of the web, the distance corresponding to each point being separately adjustable; and feeding the coating mix from the application chamber to the surface of the web to be coated to coat said surface.

2. The method of claim 1, wherein the distance between the edge of the doctoring means and the surface of the web to be coated is adjusted.

3. An apparatus for coating a moving web with a coating mix comprising:

a backing roll over which the web is able to pass;

a frame;

a doctoring means positioned proximate a surface of the web to be coated for smoothing the coating mix applied to the web supported by said backing roll, said doctoring means extending across at least a portion of a width of the web, said doctoring means being mounted to said frame so that a distance between an edge of said doctoring means and the surface of the web to be coated is adjustable;

a front planar member disposed a distance from said doctoring means in a direction counter to movement of the web, an edge of said front planar member being disposed at a distance from the surface of the web to be coated, and extending across at least a portion of the width of the web, said front planar member being formed and being mounted to said frame so that the distance between the edge of said front planar member and the surface of the web to be coated is adjustable at a plurality of points across the width of the web, the distance corresponding to each point being separately adjustable;

an application chamber formed by the surface of the web to be coated, said doctoring means and said front planar member; and a feeding means for feeding the coating mix into the application chamber.

4. The apparatus of claim 3, wherein said apparatus is a short dwell time coater.

5. The apparatus of claim 4, wherein said doctoring means is a doctor blade.

6. The apparatus of claim 3, wherein said doctoring means is a doctor blade.

7. The apparatus of claim 3, wherein said front planar member further comprises an isthmus portion extending from the edge of said planar member and being formed of a material more rigid than material comprising portions of said front planar member adjacent the isthmus portion.

8. The apparatus of claim 7, wherein said doctoring means is a doctor blade.

9. The apparatus of claim 7, further comprising an actuator means contacting an end of the isthmus portion for adjusting the distance between the edge of said front planar member adjacent the isthmus and the surface of the web to be coated.

10. The apparatus of claim 9, wherein said doctoring means is a doctor blade.

11. An apparatus for coating a moving web with a coating mix comprising:

a backing roll over which the web is able to pass;

a frame;

a doctoring means positioned proximate a surface of the web to be coated for smoothing the coating mix applied to the web supported by said backing roll, said doctoring means extending across at least a portion of a width of the web, said doctoring means being mounted to said frame so that a distance between an edge of said doctoring means and the surface of the web to be coated is adjustable;

a front planar member disposed a distance from said doctoring means in a direction counter to movement of the web, an edge of said front planar member being disposed at a distance from the surface of the web to be coated, and extending across at least a portion of the width of the web, said front planar member being formed and being mounted to said frame so that the distance between the edge of said front planar member and the surface of the web to be coated is adjustable at a plurality of points across the width of the web, said front planar member further comprising an isthmus portion extending from the edge of said planar member and being formed of a material more rigid than material comprising portions of said front planar member adjacent the isthmus portion;

an application chamber formed by the surface of the web to be coated, said doctoring means and said front planar member; and a feeding means for feeding the coating mix into the application chamber.

12. The apparatus of claim 11, further comprising an actuator means contacting an end of the isthmus portion for adjusting the distance between the edge of said front planar member adjacent the isthmus and the surface of the web to be coated.

13. The apparatus of claim 12, wherein said doctoring means is a doctor blade.

14. The apparatus of claim 11, wherein said doctoring means is a doctor blade.

* * * * *